US008955481B2

(12) United States Patent
Manther

(10) Patent No.: US 8,955,481 B2
(45) **Date of Patent: *Feb. 17, 2015**

(54) THREE ARM FINGER FOLLOWER WITH CAM SWITCHING PROFILE AND COMPRESSION LOST MOTION SPRINGS

(71) Applicant: Schaeffler Technologies AG & Co. KG, Herzogenaurach (DE)

(72) Inventor: Debora Manther, Royal Oak, MI (US)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 31 days.

This patent is subject to a terminal disclaimer.

(21) Appl. No.: 13/783,532

(22) Filed: Mar. 4, 2013

(65) Prior Publication Data

US 2013/0239919 A1 Sep. 19, 2013

Related U.S. Application Data

(60) Provisional application No. 61/611,853, filed on Mar. 16, 2012.

(51) Int. Cl.

| | |
|---|---|
| ***F01L 1/18*** | (2006.01) |
| ***F01L 13/00*** | (2006.01) |
| *F01L 1/46* | (2006.01) |

(52) U.S. Cl.

CPC ..... *F01L 1/181* (2013.01); *F01L 1/185* (2013.01); *F01L 13/0036* (2013.01); *F01L 2001/186* (2013.01); *F01L 2001/467* (2013.01)

USPC ..... 123/90.39; 123/90.44; 74/559; 74/569

(58) Field of Classification Search

USPC ..... 123/90.39, 90.44; 74/559, 569

See application file for complete search history.

(56) References Cited

U.S. PATENT DOCUMENTS

| | | | | |
|---|---|---|---|---|
| 7,174,869 | B2 | 2/2007 | Proschko et al. | |
| 7,909,007 | B2 | 3/2011 | Manther et al. | |
| 8,297,243 | B2 * | 10/2012 | Kang | 123/90.16 |
| 2011/0197843 | A1 | 8/2011 | Manther | |

* cited by examiner

*Primary Examiner* — Ching Chang

(74) *Attorney, Agent, or Firm* — Volpe and Koenig, P.C.

(57) ABSTRACT

A switchable roller finger follower is provided having an inner lever and two separate outer arms mounted at one end to a swing pivot axle that extends through the inner lever. A roller is mounted in the inner lever. The outer arms extend longitudinally along sides of the inner lever and include high lift cam contact surfaces. The inner lever includes a compression spring support extending out from each of the sides. The outer arms each include a corresponding spring support facing the respective spring support of the inner lever. A compression spring is located on each of the sides of the inner lever between the corresponding spring supports. A coupling arrangement is located between the inner lever and the outer arms which in a locked position, locks the outer arms in position on the inner lever, and in an unlocked position, allows the outer arms to pivot.

10 Claims, 3 Drawing Sheets

THREE ARM FINGER FOLLOWER WITH CAM SWITCHING PROFILE AND COMPRESSION LOST MOTION SPRINGS

FIELD OF INVENTION

The invention relates to roller finger followers that are used in overhead cam type internal combustion engines and, more particularly, to switchable roller finger followers that have a high lift and a low lift mode.

BACKGROUND

Switchable roller finger followers are known. See, for example, U.S. Pat. No. 7,174,869. Such finger followers have an outer lever pivotably mounted outside an inner lever and a roller rotatably mounted on a transverse axle in a slot in the inner lever. The top surface of the outer lever acts as a contact surface for a high lift cam and the top surface of the roller acts as a contact surface for a low lift cam. A coupling element is mounted at one end of the finger and oil from an oil source is used to activate the coupling element. When the coupling element is activated, it locks the outer lever to the inner lever and requires the follower to follow the high lift cam and transfer the lift to the valve stem of an associated intake or exhaust valve. When the coupling element is deactivated, the outer lever is free to pivot relative to the inner lever and, under the aid of a spring, the outer lever pivots freely in conjunction with the high lift cam while the motion of the low lift cam is transferred by the inner lever to the valve stem. This movement by the outer lever is conventionally referred to as the lost motion stroke.

Conventionally, the outer lever is a unitary structure such that the coupling element need only operate on one part of the outer lever. Typically, the coupling device operated on a yoke portion of the outer layer, the yoke portion being transverse to the longitudinal axis of the finger follower. Conventionally, the roller axle is staked to the inner lever to maintain its lateral position relative to the inner lever. U.S. Pat. No. 7,909,007 discloses a roller finger follower of this type. This provides a lost motion spring to maintain contact between the cam follower and the cam.

US2011/0197843 discloses the inventor's prior switchable roller finger follower in which the outer arm is formed by two separate outer arms that can move independently from one another and are connected to a common coupling element. However, the outer arms have a fairly complex configuration and associated cost. US2011/0197843 is incorporated herein by reference as if fully set forth.

It would be desirable to provide a finger follower of the type noted above with simpler manufacturing and reduced costs.

SUMMARY

Briefly stated, a switchable roller finger follower is provided having an inner lever and two separate outer arms mounted at one end to a swing pivot axle that extends through an opening in a first end of the inner lever. A roller is rotatably mounted on a transverse axle in a slot in the inner lever. The outer arms extend longitudinally along sides of the inner lever towards the other end of the inner lever and include high lift cam contact surfaces located adjacent to the roller. The inner lever includes a compression spring support extending out from each of the sides toward a respective one of the outer arms. Each of the outer arms includes a corresponding spring support located in a position facing the respective compression spring support of the inner lever. A compression spring is located on each of the sides of the inner lever between the compression spring supports and the corresponding spring supports on the outer arms. A coupling arrangement is located between the inner lever and the outer arms which in a locked position, locks the outer arms in position on the inner lever, at least in an activation direction, and in an unlocked position, allows the outer arms to pivot relative to the inner lever.

In one embodiment, the outer arms are attached in a rotationally fixed manner to the swing pivot axle so that they pivot together as a unit. In another embodiment, the outer arms are held with a slip fit on the swing pivot axle and can pivot relative to the swing pivot axle. The outer arms are held axially in position by snap rings, spring clips or staking.

Preferably, the compression springs are located in line with a cam contact force vector to provide optimal support. This is preferably in line with the transverse axle that supports the roller.

The coupling arrangement preferably includes hydraulically actuated coupling elements that extend from the inner lever into receiving openings located in the outer arms. The coupling elements are preferably spring biased to an unlocked position. However, it would also be possible to have the coupling elements spring biased to the locked position depending on the particular arrangement.

Alternatively, the coupling element can be a clutch located on the swing pivot axle between the inner and outer levers.

Using one or more of these features results in a switchable finger follower with reduced complexity allowing easier manufacturing and assembly, a low weight, and a low mass moment of inertia.

Other aspects of the invention are described below and in the claims, and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
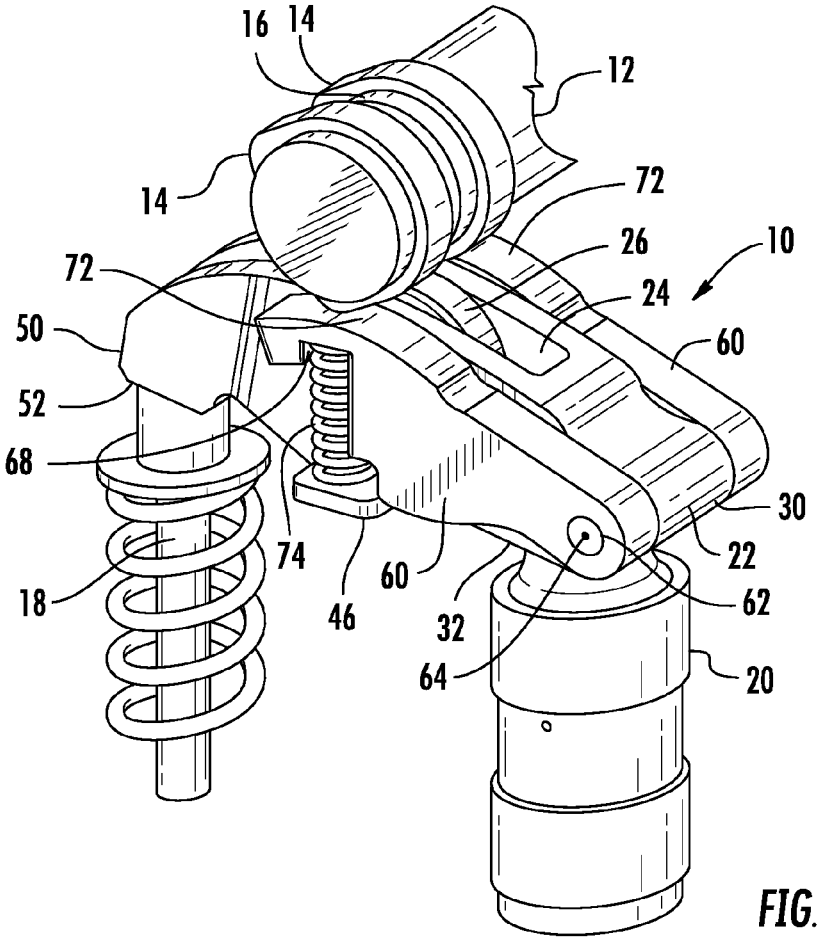
FIG. 1 is a perspective view of a switchable finger follower according to the invention shown in a position of use with a camshaft, a support element and a valve stem.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

FIG. 1 shows a switchable finger follower 10 in accordance with the present invention in the position of use in a valve train of an internal combustion engine. The finger follower 10 is positioned beneath an overhead cam shaft 12 having outer cams 14 with a high lift and an inner cam 16 with a low lift, all of which act on the switchable finger follower 10. A lash adjuster support 20 is located beneath a first end 30 of the switchable finger follower 10 and a valve stem 18 for an intake or exhaust valve is located beneath a second end 50 of the switchable finger follower 10.

Figure 2:
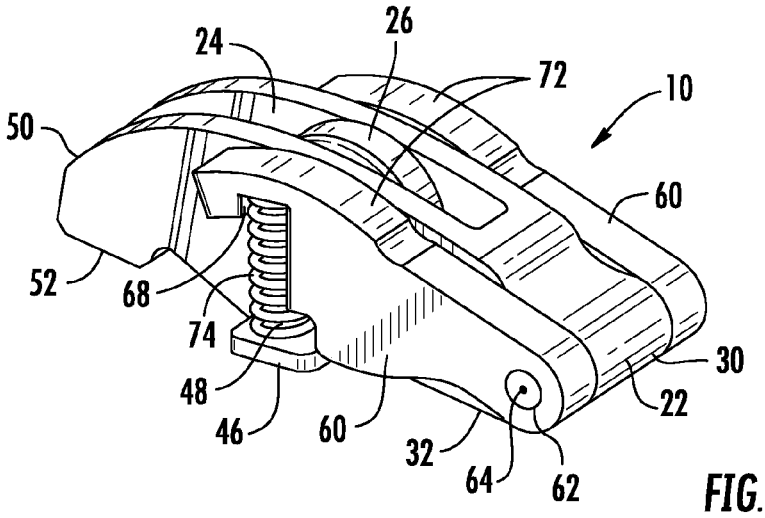
FIG. 2 is a perspective view of the switchable finger follower of FIG. 1.
Figure 3:
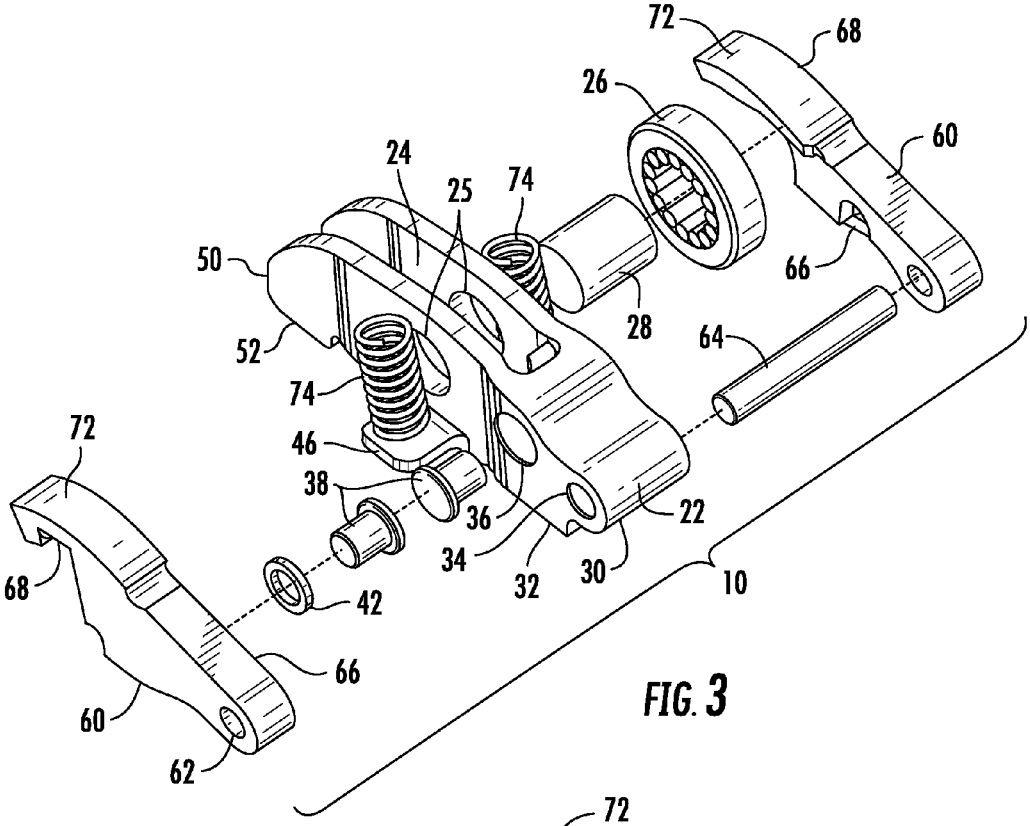
FIG. 3 is an exploded perspective view of the switchable finger follower of FIG. 2.
Figure 6:
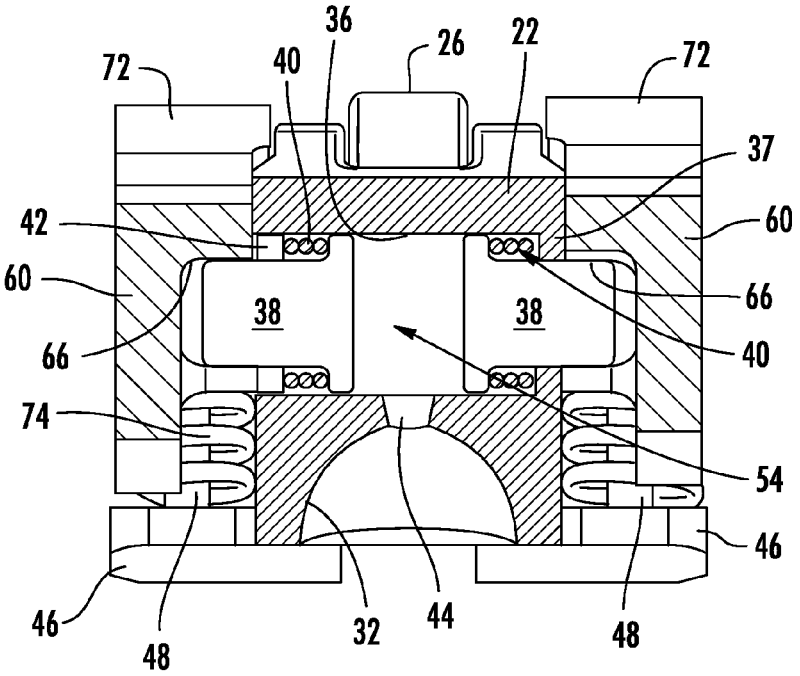
FIG. 6 is a cross-sectional view through the switchable finger follower showing the coupling arrangement in a locked position.
Figure 7:
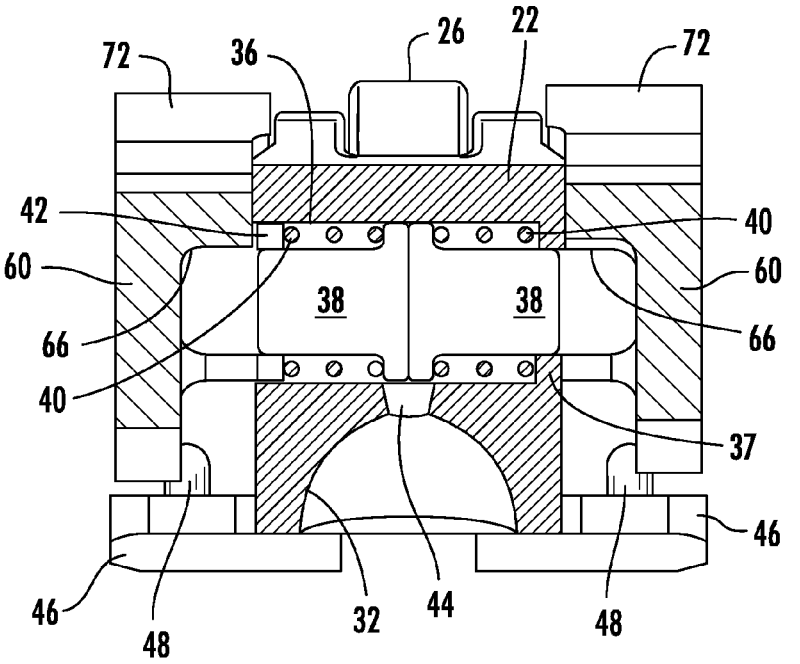
FIG. 7 is a cross-sectional view through the switchable finger follower showing the coupling arrangement in an unlocked position.

Referring to FIGS. 1-3, the switchable roller finger follower 10 is provided with an inner lever 22 and two separate outer arms 60 mounted at a first end 30 of the inner lever 22. As shown in detail in FIG. 3, the inner lever 22 includes a slot 24 in which a roller 26 is mounted for rotation on a transverse axle 28 that extends through holes 25 located on either side of the slot 24. At the first end 30 of the finger follower 10, a support receptacle 32 is provided in the inner lever 22, shown in greater detail in FIGS. 6 and 7, which is supported on the end of the lash adjuster support 20. A pivot pin hole 34 extends through the inner lever 22 at the first end 30 and is adapted to receive the pivot pin 64 which supports the outer arms 60, through pivot pin hole 62. A hole 36 is provided for coupling elements 38 which are used in order to lock the outer arm 60 to the inner lever 22, at least in an activation direction for opening an intake or exhaust valve. These coupling elements 38, shown in detail in FIGS. 3, 6, and 7, are biased inwardly by springs 40 which rest against a lip 37 at a first end of the hole 36 and a lock ring 42 pressed into the second end of the hole 36 which bias the coupling elements 38 to an uncoupled position, shown in FIG. 7. An oil feed line 44, shown in FIGS. 6 and 7, extends from the support receptacle 32 which rests on the end of the lash adjuster support 20 and feeds pressurized hydraulic medium into an oil chamber 54, shown in FIG. 6, located between the coupling elements 38 in order to force the coupling elements into a locked position, also shown in FIG. 6. When sufficient hydraulic medium is supplied under pressure from the lash adjuster support 20, it overcomes the force of the springs 40 in order to press the coupling elements 38 outward into the locked position. This lock can also be reversed where the springs bias the coupling elements 38 to a coupled position.

Referring again to FIG. 3, the second end 50 of the inner lever 22 includes a valve stem pallet 52 which acts against the end of the valve stem 18 in order to press the associated valve open to a greater or lesser degree depending upon the position of the cams 14 or 16 and whether the coupling elements 38 are in the locked or unlocked position.

Figure 4:
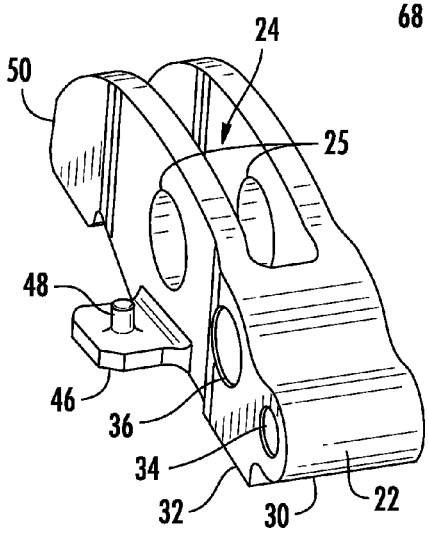
FIG. 4 is a perspective side view of the inner lever alone showing the spring support and spring boss.

The inner lever 22 further includes compression spring supports 46 which extend out from each of the sides of the inner lever 22 toward a respective one of the outer arms 60. The spring supports 46 on the inner lever 22 also include spring bosses 48, shown most clearly in FIGS. 4 and 7, which maintain the springs 74 in position.

Still with reference to FIGS. 1-3, the outer arms 60 are shown and extend longitudinally along the sides of the inner lever 22 toward the second end 50. The outer arms 60 include high lift cam contact surfaces 72 which are located adjacent to the roller 26. In one embodiment the outer arms 60 are attached in a rotationally fixed manner to a swing pivot axle 64 that extends through the pivot pin hole 34 in the inner lever 22 so that the outer arms 60 pivot together as a unit. Alternatively, the outer arms 60 can be held with a slip fit on the swing pivot axle 64 so that they can pivot relative to the swing pivot axle 64, which can be press fit into the pivot pin hole 34 in the inner lever 22. In this case, retainers are provided to axially hold the outer arms in position, such as snap rings, spring clips or staking.

Figure 5:
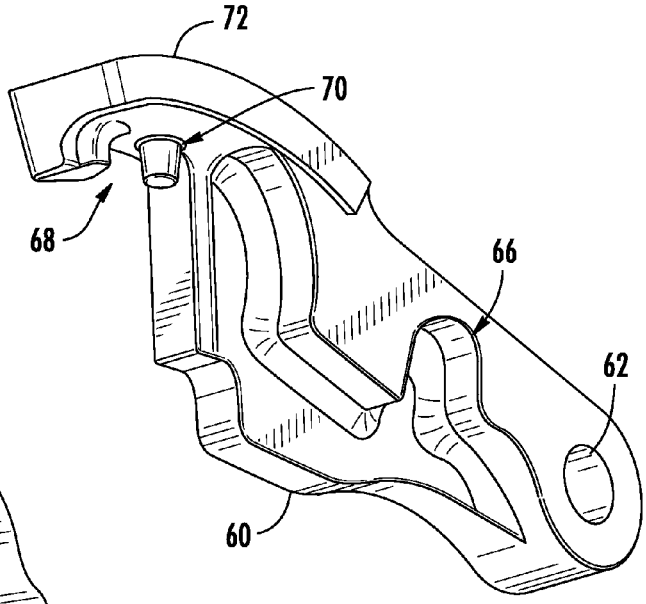
FIG. 5 is a perspective side view showing the inside of one of the outer arms showing the coupling element receptacle and the spring boss.

As shown in FIGS. 1, 2 and 5, the outer arms 60 include a spring support groove 68 along with a spring boss 70 for holding the springs 74 in position. The springs 74 are located on each of the sides of the inner lever 22 between the supports 46 on the inner lever 22 and the corresponding supports on the outer arms 60. This arrangement provides for easier assembly and manufacture of the switchable roller finger follower 10 since the springs 74 are standard compression springs and can be assembled to the inner lever 22 and outer arms 60 from the side. Further, due to the simplified configuration, the outer arms 60 are easier to machine.

Referring particularly to FIG. 5, the outer arms 60 each include a coupling element receptacle 66. In the preferred embodiment, this is in the form of a slot that is open at the bottom so that it is easier for the coupling elements 38 to engage, with the top of the slot 66 acting on the coupling elements 38 when they are in the locked position in order to transfer the lift force of the cam on the outer arms 60 to the valve stem 18. However, the coupling element receptacles 66 could also be blind bores.

Referring to FIGS. 3, 6 and 7, the coupling arrangement formed via the coupling elements 38 in the inner lever 22 and coupling element receptacles 66 located in each of the outer arms 60 will be explained in further detail. When no or only low pressure hydraulic medium is supplied to the oil chamber 54 between the coupling elements 38 in the inner lever 22, as shown in FIG. 7, the coupling elements 38 are in an unlocked state in which the outer arms 60 can pivot about the swing pivot axle 64 relative to the inner lever 22. This means that the cam lift transferred via the cams 14 to the high lift cam surfaces 72 on the outer arm 60 compresses the springs 74 as the outer arms 60 pivot relative to the inner lever 22 so that the motion of the high lift outer cams 14 is compensated while the lift of the inner cam 16 acting on the roller 26 is transferred via the inner lever 22 to the valve stem 18. When sufficient oil pressure is provided to the oil chamber 54 between the coupling elements 38 to overcome the force of the springs 40, the springs 40 are compressed and the coupling elements 38 extend into the receptacles 66 in the outer arms 60 so that the high lift of the outer cams 14 acting on the switchable finger follower 10 is transferred via the coupling arrangement from the outer arms 60 to the inner lever 22 resulting in a higher lift of the valve stem 18 as it is opened.

In the preferred embodiment, the springs 74 which compensate for the motion of the high-lift cams 14 in the unlocked position are located in line with a cam contact force vector to provide optimal support. The cam contact force vector is preferably in line with the transverse axle 28 that supports the roller 26 to provide optimum force transfer from the inner cam 16 to the roller 26 when the coupling arrangement formed by the coupling elements 38 and the receptacle 66 is in the unlocked position.

While the preferred embodiment of the invention has been described in detail, those skilled in the art will recognize that other changes could be made to a switchable roller finger follower without departing from the scope of the present invention. Other types of coupling arrangements could be provided and the specific configuration of the inner lever and outer arms could be varied without departing from the scope of the present invention. Accordingly, the scope of the invention should not be limited by the preferred embodiments discussed above and instead should be defined by the claims as noted below.

What is claimed is:

1. A switchable roller finger follower having a high lift and a low lift mode for a valve train of an internal combustion engine, comprising:

an inner lever having a slot in which a roller is mounted by a transverse axle;

two separate outer arms that extend along longitudinal sides of the inner lever that are mounted for pivoting movement at one end of the inner lever by a swing pivot axle, the two separate outer arms each include a high lift cam contact surface located adjacent to the roller;

the inner lever includes compression spring supports extending out from each of the longitudinal sides toward a respective one of the two separate outer arms, and each of the two separate outer arms includes a corresponding spring support located in a position facing a respective one of the compression spring supports of the inner lever;

a compression spring is located on each of the longitudinal sides of the inner lever between the compression spring supports and the corresponding spring supports on the two separate outer arms; and a coupling arrangement is located between the inner lever and the two separate outer arms which in a locked position, locks the two separate outer arms to the inner lever at least in an activation direction of a valve, and in an unlocked position, allows the two separate outer arms to pivot relative to the inner lever.

2. The switchable roller finger follower of claim 1, wherein the two separate outer arms are attached in a rotationally fixed manner to the swing pivot axle so that they pivot together as a unit.

3. The switchable roller finger follower of claim 1, wherein the two separate outer arms are held with a slip fit on the swing pivot axle and can pivot relative to the swing pivot axle.

4. The switchable roller finger follower of claim 1, wherein the compression springs are located in line with a cam contact force vector, in line with the transverse axle that supports the roller.

5. The switchable roller finger follower of claim 1, wherein the coupling arrangement includes hydraulically actuated coupling elements that extend from the inner lever into coupling element receptacles located in each of the two separate outer arms.

6. The switchable roller finger follower of claim 5, wherein the coupling element receptacles are formed as a slot in each of the two separate outer arms that face a respective one of the longitudinal sides of the inner lever, with a top of each of the slots acting on the coupling elements when the coupling elements are in the locked position in order to transfer a cam lift force.

7. The switchable roller finger follower of claim 5, wherein the coupling elements are spring biased to an unlocked position.

8. The switchable roller finger follower of claim 5, wherein the coupling elements are located in a hole in the inner lever having a lip at a first end and being held in the hole by a lock ring that is press fit in the second end of the hole.

9. The switchable roller finger follower of claim 1, wherein a spring boss is located on each of the compression spring supports of the inner lever and on each of the two separate outer arms, and the compression springs are insertable from the longitudinal sides between the spring bosses on the two separate outer arms and the inner lever which retain the compression springs in position.

10. The switchable roller finger follower of claim 1, wherein the coupling arrangement includes a clutch element located between the inner lever and the two separate outer arms.

* * * * *